United States Patent [19]

Levine et al.

[11] Patent Number: 4,951,473

[45] Date of Patent: Aug. 28, 1990

[54] HEAT PUMP DEFROSTING OPERATION

[75] Inventors: Michael Levine, Boca Raton, Fla.; James Russo, Ann Arbor, Mich.; Victor Rigotti, Ann Arbor, Mich.; Nicholas Skogler, Ypsilanti, Mich.

[73] Assignee: Honeywell, Inc., Minneapolis, Minn.

[21] Appl. No.: 256,708

[22] Filed: Oct. 12, 1988

[51] Int. Cl.[5] ..... F25D 21/12

[52] U.S. Cl. ..... 62/82; 62/156; 62/158; 62/282

[58] Field of Search ..... 62/180, 160, 155, 156, 62/151, 186, 234, 272, 282, 80, 82, 158

[56] References Cited

U.S. PATENT DOCUMENTS

| | | | |
|---|---|---|---|
| 2,001,027 | 5/1935 | Kitzmiller | 62/81 |
| 2,178,807 | 11/1939 | Ploeger | 62/80 |
| 2,525,869 | 10/1950 | Corhanidis | 62/282 |
| 2,763,132 | 9/1956 | Jue | 62/82 X |
| 2,947,153 | 8/1960 | Atchison | 62/156 |
| 3,070,972 | 1/1963 | Atchison | 62/180 |
| 3,115,017 | 12/1963 | Krocher et al. | 62/155 |
| 3,877,243 | 4/1975 | Kramer | 62/180 |
| 4,086,779 | 5/1978 | Lewis | 62/140 |
| 4,102,391 | 7/1978 | Noland et al. | 62/156 X |
| 4,122,892 | 10/1978 | Delaporte | 62/282 X |
| 4,245,482 | 1/1981 | Abraham | 62/256 |
| 4,271,898 | 6/1981 | Freeman | 62/186 X |
| 4,373,350 | 2/1983 | Noland | 62/156 |
| 4,439,995 | 4/1984 | McCarty | 62/156 |
| 4,478,055 | 10/1984 | Drucker | 62/324.1 |
| 4,530,217 | 7/1985 | Alluto et al. | 62/156 |
| 4,627,245 | 12/1986 | Levine | 62/157 |
| 4,648,551 | 3/1987 | Thompson et al. | 236/49 |
| 4,662,184 | 5/1987 | Pohl et al. | 62/156 |
| 4,745,766 | 5/1988 | Bahr | 62/176.6 |
| 4,773,587 | 9/1988 | Lipman | 236/11 |

FOREIGN PATENT DOCUMENTS

| | | | |
|---|---|---|---|
| 3238354 | 4/1984 | Fed. Rep. of Germany | 62/155 |

*Primary Examiner*—Harry B. Tanner

*Attorney, Agent, or Firm*—Krass & Young

[57] ABSTRACT

The present invention is a technique for a defrosting opereation of a heat pump. External air provides the heat for defrosting the exterior heat exchanger by operating the exterior fan during times when the compressor is not operating, the temperature of the exterior heat exchanger is below freezing and the exterior air temperature is above freezing. In accordance with one embodiment of the present invention the temperature of the exterior heat exchanger and the exterior are measured via separate temperature sensors. In accordance with an alternative embodiment, the exterior heat exchanger temperature is measured via a single temperature sensor and the exterior fan is operated for a predetermined interval of time after the compressor is stopped. Thereafter the exterior fan is operated only so long as the temperature remains at freezing. In a still further embodiment, the exterior fan is operated only so long as it remains less than or equal to freezing and does not reach a plateau at less than freezing. The operation of the exterior fan after deactuation of the compressor may be inhibited throughout an interval of time, if the plateau temperature was less than freezing.

16 Claims, 6 Drawing Sheets

HEAT PUMP DEFROSTING OPERATION

Technical Field of the Invention

The technical field of the present invention is the control of heat pumps, and in particular the control of heat pumps to provide defrosting operation.

Background of the Invention

Heat pumps are temperature modification devices which are typically employed to heat an interior space. Heat pumps operate to transport heat from colder exterior air to warm the interior space. This heat transfer is achieved via control of the liquid/gas state change of a refrigerant.

A compressor receives the refrigerant in a gaseous state and through the introduction of pressure changes the state of the refrigerant into a liquid. This process will raise the temperature of the refrigerant. An interior heat exchanger enables heat transport from the hot refrigerant into the air of the interior space. Typically a fan is employed to transport interior air over the interior heat exchanger to facilitate this heat transfer.

The liquid refrigerant is then routed to a evaporator. In the evaporator, the pressure provided by the compressor is released. This causes the refrigerant to vaporize from the liquid state into the gaseous state. Much of the heat of the liquid refrigerant is needed to provide the heat of vaporization. As a consequence, the gaseous refrigerant which emerges from the evaporator is at a much lower temperature than the entering liquid refrigerant.

This lower temperature gaseous refrigerant is then routed to an exterior heat exchanger. This exterior heat exchanger is similar to the interior heat exchanger, except that heat flows from the exterior air into the colder gaseous refrigerant. As in the case of the interior heat exchanger, the exterior heat exchanger typically has an exterior fan to transport exterior air over the exterior heat exchanger to facilitate the heat transfer. The gaseous refrigerant, with its temperature elevated by heat from the exterior air, is then routed to the compressor to repeat the cycle.

The net result of this cycle is the transportation of heat from the colder exterior air to warm the interior air. The temperature of the liquid refrigerant from the compressor would typically be 110 degrees Fahrenheit. The refrigerant would typically be cooled to approximately 100 degrees Fahrenheit in the interior heat exchanger by heating the interior air which would be approximately 70 degrees Fahrenheit. The gaseous refrigerant emerging from the evaporator would typically be much colder, approximately 0 degrees Fahrenheit. Exterior air in the range of 60 degrees Fahrenheit to 35 degrees Fahrenheit would typically heat the gaseous refrigerant to a temperature of approximately 28 degrees Fahrenheit. By thus controlling the liquid/gas state changes of the refrigerant it is possible to transport heat from the colder exterior to heat the warmer interior space. The amount of electrical energy required to transport this heat (the electrical power consumption of the compressor and the interior and exterior fans) is generally less than the electrical energy equivalent of this heat. Thus a heat pump provides greater heating than an electric resistance heater using the same amount of electrical power.

Heat pumps have some disadvantages and limitations which prevent their more widespread use. Firstly, heat transport mechanism is based upon the limited temperature differential achieved by converting the refrigerant from a gas to a liquid and then from a liquid back to a gas. This temperature differential must be greater than the temperature differential between the interior space and the exterior in order for the desired heat transfer to take place. In addition, the heat transport mechanism is most efficient when the temperature differential between the interior and exterior is minimal. Thus the heat transport process is least efficient at the same time the need for heat transfer is greatest, when the exterior ambient temperature is very low. As a consequence a heat pump system is often teamed with an auxiliary heating unit, such as a gas or oil fired furnace, for use when the heat pump is inadequate to provide the desired interior temperature.

Secondly, there is a further factor that reduces the usefulness of heat pumps at low exterior ambient temperatures. The formation of frost on the exterior heat exchanger severely limits the usefulness of heat pumps. Because the refrigerant can have a temperature in the range of 0 degrees Fahrenheit, heat transfer could theoretically take place for exterior ambient temperatures below freezing (32 degrees Fahrenheit). However because of the low temperature of the refrigerant in the exterior heat exchanger, frost tends to form on the exterior heat exchanger from freezing of the humidity in the exterior air even when the exterior ambient temperature is above freezing. Typically frost would begin to form at exterior ambient temperatures in the range of 35 degrees Fahrenheit to 37 degrees Fahrenheit. The build up of such frost tends to insulate the exterior heat exchanger from the exterior air, thus inhibiting the heat transport process. In the prior art there are known systems to detect the build up of frost or the conditions which are known to cause such build up. In accordance with the prior art, there are systems which reverse the connection of the interior and exterior heat exchangers. This results in the transport of the hot liquid refrigerant to the exterior heat exchanger causing the frost to be melted. Unfortunately, this causes the heat pump to act as an air conditioner, transporting heat from the interior to the exterior, generally at the very time that heating is most desired.

The two factors noted above limit the usefulness of the heat pump in certain climates. If the exterior ambient temperature will be below freezing for any significant portion of the heating season, then either heat pumps are only rarely installed or heat pumps must be backed up with an auxiliary heating unit. This results in the requirement for extra equipment which is only intermittently used. The prior art method for melting frost on the exterior heat exchanger places an additional heating load on the heating system at the same time that heat is most needed by cooling the interior space in order to heat the exterior heat exchanger.

Studies of the temperature patterns of many U.S. cities show that a reduction of only a few degrees in the lowest operating temperature of a heat pump would greatly increase the areas where heat pumps could be used exclusively and greatly reduce the need for auxiliary heat in other regions. Any method of operation of a heat pumps that would prevent or delay frost build up could provide such an improvement in the lowest operating temperature. Therefore it would be very useful in the heat pump field to provide a method for frost free operation.

Summary of the Invention

The present invention is a manner of control of heat pumps for defrosting operation. This technique enables the effective use of a heat pump for lower exterior ambient temperatures than previously permitted. This lowering of the lowest Operating temperature will permit heat pumps to be effectively used for a greater proportion of the heating season in many localities.

The present invention takes advantage of the ambient conditions when frost first begins to form on the exterior heat exchanger. Because the refrigerant entering the exterior heat exchanger is typically has a temperature well below freezing, frost usually begins to form for exterior ambient temperatures which are above freezing. The present invention takes advantage of this fact by employing the exterior air to melt frost.

The present invention employs the exterior fan during times the compressor is turned off. The exterior fan is employed to transport exterior air over the exterior heat exchanger when: (1) the compressor is off; (2) the temperature of the exterior heat exchanger is less than or equal to freezing (permitting the formation of frost); and (3) the exterior air temperature is above freezing. Under these conditions, the exterior air transported by the exterior fan tends to melt the frost. In accordance with the preferred embodiment of the present invention, the exterior fan is kept operating only so long as the exterior heat exchanger temperature is less than or equal to freezing. By employing the exterior air in this manner the frost can be removed without the expenditure of a great deal of energy. The heat to defrost the exterior heat exchanger comes from the exterior air.

The invention requires an indication of the exterior heat exchanger temperature and of the exterior ambient temperature. In accordance with a first embodiment of the present invention these temperatures are directly measured employing a pair of temperature sensors. A first temperature sensor measures the temperature of the exterior heat exchanger. A second temperature sensor measures the temperature of the exterior ambient air. With these two temperatures directly measured, the above algorithm is employed to defrost the heat pump when required.

In accordance with a further aspect of the present invention a single temperature sensor detecting the temperature of the exterior heat exchanger is employed. The exterior fan is employed to transport exterior air over the exterior heat exchanger for an interval after the compressor is turned off. This may be a predetermined time interval, which is preferably approximately four minutes.

In the case that the exterior fan is operated for a predetermined interval of time, the temperature of the exterior heat exchanger is measured at the end of this predetermined interval of time. If the exterior heat exchanger temperature is greater than freezing no frost formation is possible. Accordingly the exterior fan is turned off. If the exterior heat exchanger temperature is less than freezing at the end of this interval, it is anticipated that the exterior ambient temperature is also less than freezing. Under these conditions running the exterior fan cannot defrost the exterior heat exchanger. Accordingly, the exterior fan is turned off. A defrost operation of another type, such as the reverse operation known in the prior art, may be necessary under these conditions. Lastly, the exterior heat exchanger temperature could be exactly freezing. Under these conditions it is anticipated that frost has formed on the exterior heat exchanger and the the exterior ambient temperature is greater than freezing. If this is the case the exterior heat exchanger temperature will remain at freezing until the frost is completely melted. The exterior fan is kept on and the exterior air transported by the exterior fan tends to melt the frost. In accordance with the preferred embodiment of the present invention, the exterior fan is kept operating until the exterior heat exchanger temperature is raised above freezing, indicating that the frost is completely melted.

The present invention enables defrosting during the operation of a heat pump in a manner requiring little energy. This invention will reduce the exterior ambient temperature at which defrost operations as known in the prior art are required. These prior art defrosting operations generally require large amounts of energy and may even cool the interior space to be warmed. This reduction in the temperature at which conventional energy consuming defrost operations are required, even if only a few degrees, greatly extends the proportion of the heating season during which a heat pump may be advantageously employed.

Brief Description of the Drawings

These and other aspects and features of the present invention will become clear from the foregoing description of the invention taken in conjunction with the drawings, in which.

Detailed Description of the Preferred Embodiment

Figure 1:
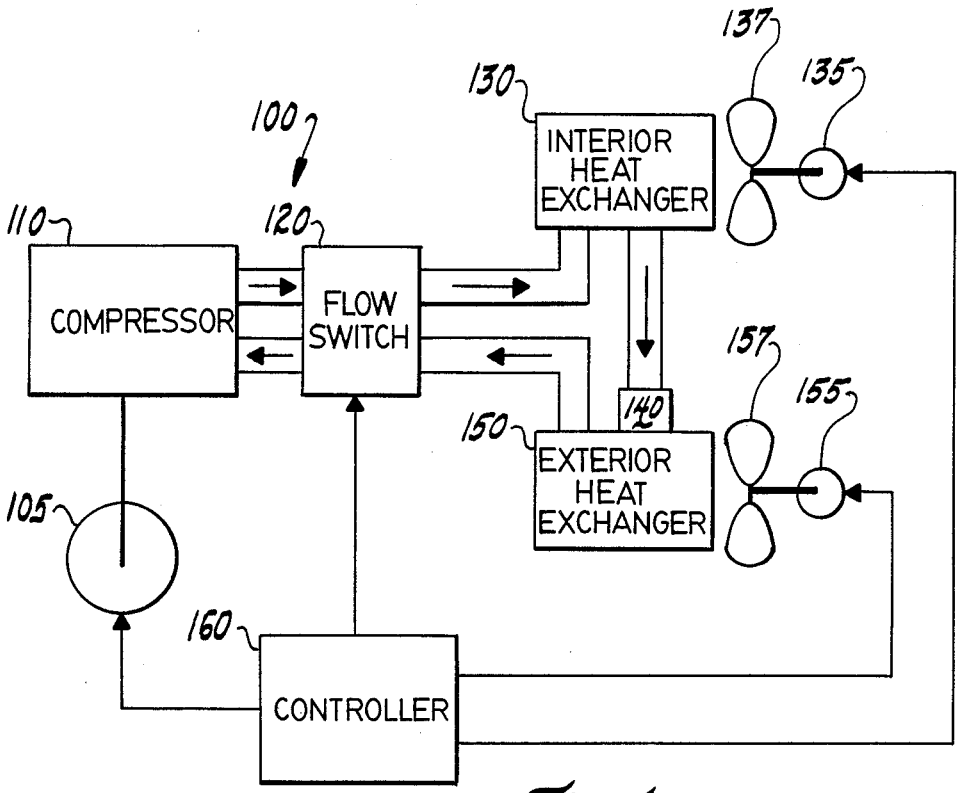
FIG. 1 illustrates the general arrangement of parts in the heat pump control system of the present invention.

FIG. 1 illustrates schematically the parts of the present invention. Heat pump 100 includes compressor 110 driven by compressor motor 105, refrigerant flow switch 120, interior heat exchanger 130 which has associated therewith interior fan motor 135 and interior fan 137, evaporator 140, exterior heat exchanger 150 which has associated therewith exterior fan motor 155 and exterior fan 157, and controller 160.

As illustrated schematically in FIG. 1, refrigerant flows through the elements of the heat pump. The arrows of FIG. 1 illustrate the refrigerant flow through refrigerant flow switch 120 during normal operation of heat pump 100. As shown in FIG. 1, refrigerant flows from compressor 110, through refrigerant flow switch 120 to interior heat exchanger 130, to evaporator 140, to exterior heat exchanger 150, back to refrigerant flow switch 120, and then returns to compressor 110. This refrigerant flow path enables heat pump 100 to transport heat from the exterior to the interior. Refrigerant flow switch 120 is provided to enable a reversed flow operation of heat pump 100. The reversed flow is from compressor 110, through refrigerant flow switch 120 to exterior heat exchanger 150, through evaporator 140, through interior heat exchanger 130, back to refrigerant flow switch 120, and then returns to compressor 110. This refrigerant flow path enables heat pump 100 to transport heat from the interior to the exterior. This reverse flow operation is employed in accordance with the teachings of the prior art to defrost exterior heat exchanger 150.

Controller 160 is coupled to compressor motor 105, refrigerant flow switch 120 interior fan motor 135 and exterior fan motor 155. Controller 160 controls the operation of heat pump 100 by control of compressor motor 105, refrigerant flow switch 120 interior fan motor 135 and exterior fan motor 155. This control includes thermostatic control of the temperature of the interior space and control of defrosting of exterior heat exchanger 150.

Figure 2:
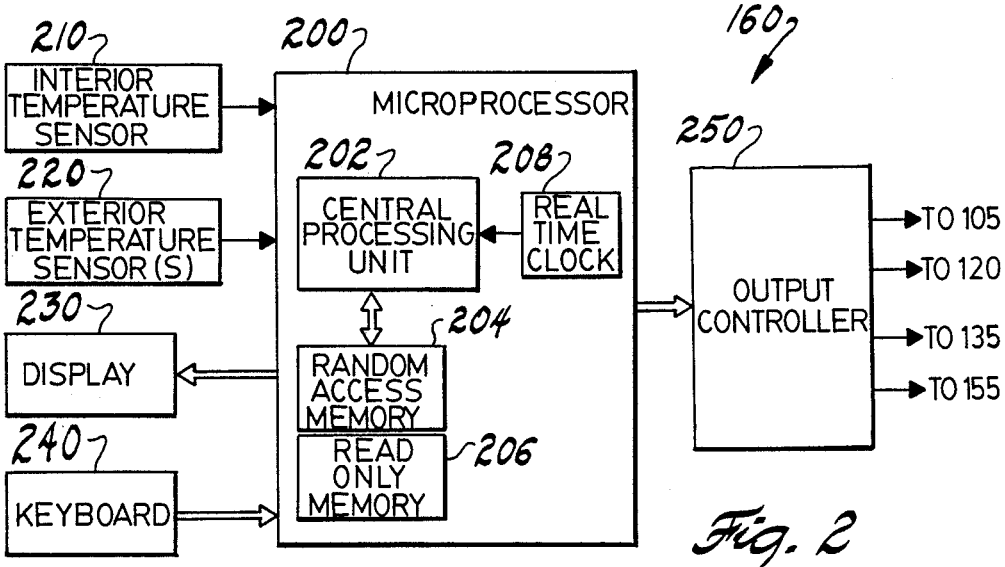
FIG. 2 illustrates further details of the heat pump controller illustrated in FIG. 1.

FIG. 2 illustrates controller 160 in further detail. Controller 160 includes microprocessor 200, interior temperature sensor 210, exterior temperature sensor(s) 220, display 230, keyboard 240 and output controller 250. Interior temperature sensor 210 is a temperature sensor which measures the interior temperature. The interior temperature is employed in the thermostatic control of heat pump 100.

Exterior temperature sensor(s) 220 are one or more temperature sensors to measure the temperature of exterior heat exchanger 150 and the temperature of the exterior air. These temperatures are employed in the control of frost. In one embodiment of the present invention exterior temperature sensor(s) 220 include a first exterior temperature sensor, which is thermally coupled to the exterior heat exchanger and insulated from the exterior air, for measuring the temperature of exterior heat exchanger 150 and a second exterior temperature sensor for measuring the temperature of the exterior air. In alternative embodiments of the present invention, only a single exterior temperature sensor measuring the temperature of the exterior heat exchanger 150 is employed, because these embodiments do not employ the temperature of the exterior air.

Display 230 is constructed in accordance with the prior art and is employed to send messages to the user of heat pump 100. Such messages could include the current time, the current interior temperature and the current set temperature. In addition, display 230 can be employed in conjunction with keyboard 240 to provide feedback to the user during entry of commands via keyboard 240. Keyboard 240 is constructed in accordance with the prior art and is employed to enable operator control of heat pump 100. Keyboard 240 can be employed to enter the current time and the current desired temperature. In addition it is known in the art to provide a sequence of desired temperatures for particular times of the day via keyboard 240 for storage within microprocessor 200. This would enable microprocessor 200 to control heat pump 100 to provide a time/temperature profile corresponding to this stored sequence of desired temperatures at particular times.

Output controller 250 is connected to compressor motor 105, refrigerant flow switch 120, interior fan motor 135 and exterior fan motor 155. Output controller 250 includes one or more relays or semiconductor switching elements needed for switching the electrical power to these elements under the control of microprocessor 200.

Microprocessor 200 is constructed in accordance with the prior art. Microprocessor 200 includes a central processing unit 202 for performing arithmetic and logic operations under program control, random access memory 204 for temporary storage of data, intermediate calculation results and the like, read only memory 206 which permanently stores a program for control of microprocessor 200 and may further store tables of constants employed in its operation, and real time clock 208 which provides an indication of the current time. Typically microprocessor 200, including central processing unit 202, random access memory 204 read only memory 206, and real time clock 208, is formed on a single integrated circuit. Microprocessor 200 is in fact a miniature programmed computer. Proper selection of the program permanently stored in read only memory 206 during manufacture of microprocessor 200 enables the identical structure to perform a variety of tasks. Naturally the specification of a particular program in read only memory 206 causes that particular microprocessor to be dedicated to the particular task implemented by that program. The flexibility in design and manufacturing provided by this technique is highly advantageous in an art that is rapidly changing.

In operation the program stored in read only memory 206 causes microprocessor 200 to control the operation of heat pump 100. This program causes microprocessor 200 to receive the input signals from interior temperature sensor 210 and exterior temperature sensor(s) 220 together with input commands from keyboard 240. Microprocessor 200 then provides an output to the user via display 230 and controls the operation of compressor motor 105, refrigerant flow switch 120, interior fan motor 135 and exterior fan motor 155 via output controller 250 in accordance to a program permanently stored in read only memory 206 in conjunction with the current time indicated by real time clock 208.

Figure 3:
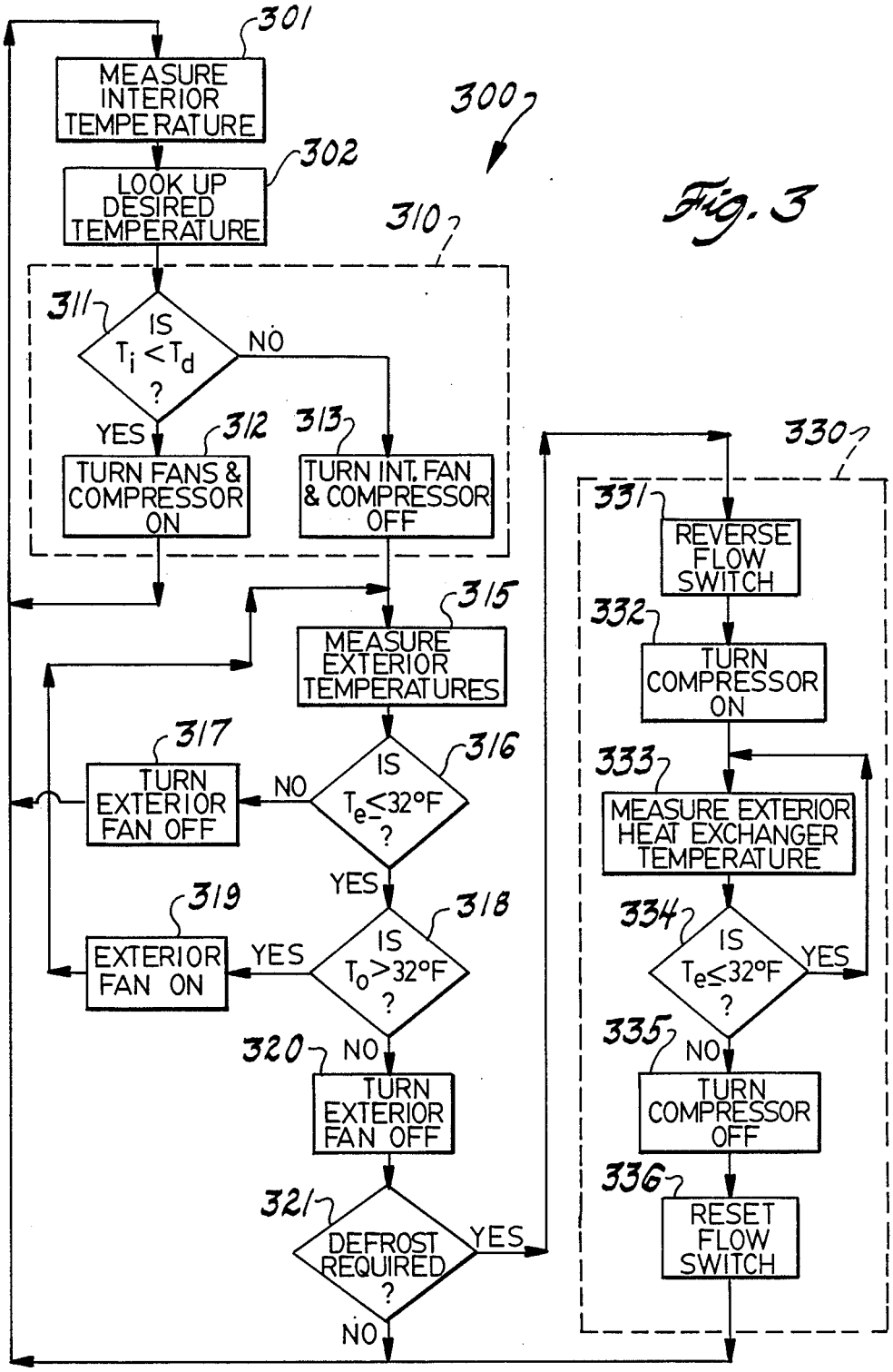
FIG. 3 illustrates a flow chart of a program suitable for execution by the microprocessor illustrated in FIG. 2 for practicing the present invention.

FIG. 3 illustrates a flow chart of program 300 used to control the operation of microprocessor 200 for achieving the thermostatic control and frost control in accordance with the present invention. Program 300 illustrated in FIG. 3 is not intended to show the exact details of the program for control of microprocessor 200. Instead, program 300 is intended to illustrate only the overall general steps employed in this program. It should also be noted that program 300 illustrated in FIG. 3 does not show all of the control processes necessary to the control of heat pump 100. In particular, program 300 does not show the manner in which operator inputs are received from keyboard 240 or the manner in which display 230 is employed to send messages to the user. Since these necessary portions of the program for operation of microprocessor 200 are known in the art and form no part of the present invention, they are omitted from the present description. Those skilled in the art of microprocessor programming would be enabled to provide the exact details of the program for control of microprocessor 200 from program 300 illustrated here and the other descriptions of the present application once the selection of the type of microprocessor unit to embody microprocessor 200 is made, together with its associated instruction set.

Program 300 is a continuous loop which is performed repetitively. For convenience the description of this continuous loop is begun with processing block 301. In processing block 301, program 300 controls microprocessor 200 to measure the interior temperature. This process takes place by reading and processing the signal from interior temperature sensor 210. The preferred embodiment of the present invention employs the variable resistance of a thermistor as interior temperature sensor 210. Microprocessor 200 preferably controls an analog to digital conversion process to convert the resistance of such a thermistor into a digital number. Lastly, microprocessor 200 preferably converts this digital measure of the resistance of the thermistor into interior temperature $T_i$ using a look up table. This process and other methods for obtaining a digital signal indicative of temperature are known in the prior art.

Program 300 next determines desired temperature $T_d$ for the current time (processing block 302). This temperature could be a set point entered via keyboard 240. In accordance with the preferred embodiment, however, this desired temperature $T_d$ is recalled from a table containing a sequence of desired temperatures for particular times of the day stored within random access memory 204. The desired temperature $T_d$ for the particular time is recalled in conjunction with the current time indicated by real time clock 208. This process is known in the art and will not be further described. The essential element of this step in program 300 is to produce desired temperature $T_d$ for comparison with interior temperature $T_i$.

Program 300 next performs the thermostatic control of heat pump 100 (subroutine 310). This process includes control of the operation of compressor motor 105, refrigerant flow switch 120, interior fan motor 135 and exterior fan motor 155 via output controller 250. Subroutine 310 illustrated in FIG. 3 shows a very simple comparison algorithm for this control process as an example only. This technique plus other more sophisticated techniques are known in the art.

Program 300 compares measured interior temperature $T_i$ with desired temperature $T_d$ (decision block 311). If measured interior temperature $T_i$ is less than desired temperature $T_d$, then compressor motor 105, interior fan motor 135 and exterior fan motor 155 are turned on or remain on if they are already on (processing block 312). This takes place by microprocessor 200 sending the proper commands to output controller 250 for actuating these motors. This serves to actuate heat pump 100 to begin transportation of heat from the exterior to the interior. Control of program 300 then returns to processing block 301 to repeat the control loop.

If measured interior temperature $T_i$ is not less than desired temperature $T_d$, then compressor motor 105 and interior fan motor 135 are turned off or remain off (processing block 313). As before, this is achieved by microprocessor 200 issuing the necessary commands to output controller 250 for deactuating these motors. Note that exterior fan motor 155 is separately controlled in accordance with the present invention.

The remainder of program 300 is concerned with the defrosting operation of heat pump 100. This portion of program 300 is entered only when compressor motor 105 and interior fan motor 135 are turned off (processing block 313). Note that if another type of thermostatic control process is employed in place of that illustrated in subroutine 310, this defrosting operation is entered immediately after the compressor motor 105 and the interior fan motor 135 are turned off. Program 300 measures the exterior heat exchanger temperature $T_e$ and the exterior ambient temperature $T_o$ (processing block 315). This takes place in much the same manner as the measurement of the interior temperature $T_i$ by reading and processing the signal or signals from exterior temperature sensor(s) 220. Because this process is similar to that previously disclosed, it will no be further described here.

Program 300 next tests to determine whether the exterior heat exchanger temperature $T_e$ is less than or equal to freezing or 32 degrees Fahrenheit (decision block 316). This corresponds to the condition in which frost can form on exterior heat exchanger 150. If this is not the case, then no defrosting operation is required. In such an event, exterior fan motor 155 is turned off or remains off (processing block 317) and program 300 returns to the beginning of the control loop at processing block 301. This separate control of the turn off of exterior fan motor 155 is feature of the present invention which permits exterior fan motor 155 to be operated independent of the other motors.

In the event that exterior heat exchanger temperature $T_e$ is less than or equal to freezing, the conditions exist promoting the formation of frost on exterior heat exchanger 150. If this is the case one of two defrost operations may be performed. Program 300 tests to determine if the exterior ambient temperature $T_o$ is greater than freezing (decision block 318). If this is the case then exterior fan motor 155 is turned on or remains on (processing block 319). In accordance with the present invention heat from the exterior air is employed to defrost exterior heat exchanger 150. Because this exterior air is at a temperature greater than freezing, it is capable of defrosting exterior heat exchanger 150. The heat of the exterior air is available by merely operating exterior fan motor 155 to cause exterior fan 157 to transport exterior air past exterior heat exchanger 150. In addition to using heat available inexpensively, this technique does not transport heat from the interior space to defrost exterior heat exchanger 150 as required by the prior art. Program 300 then returns control to processing block 315 to repeat the defrost determination. Program 300 remains in this loop, with exterior fan 157 operating until either exterior heat exchanger temperature $T_e$ is above freezing (decision block 316) or exterior ambient temperature $T_o$ is no longer greater than freezing (decision block 318). Note particularly that program 300 cannot restart heat pump 100 for heating the interior space until the frost forming conditions no longer occur.

In the event that exterior ambient temperature $T_o$ is less than or equal to freezing, the the exterior air cannot supply the heat to defrost exterior heat exchanger 150. Program 300 therefore turns off fan exchanger motor 155 (processing block 320). Program 300 next tests to determine whether a defrosting operation is required (decision block 321). There are techniques known in the art for making this determination. Note that even though the exterior heat exchanger temperature and the exterior ambient temperature are both below freezing, it is possible that no frost has formed due to low humidity, for example. In addition, it is possible that the amount of frost formed is so small that a defrosting operation is not required at this time. This determination is made at this time because the defrosting operations known in the prior art expend considerable energy and may cool the interior space. It is considered prudent to make this test before proceeding with the prior art defrosting operation. In the case of operation of the exterior fan 157 for defrosting such a determination is not necessary. This is because the operation of exterior fan motor 155 requires very little energy compared to the amount of energy needed for a prior art defrosting operation. In addition, operation of the exterior fan 157 does not cool the interior space. In the event that a defrosting operation is not required, control of program 300 returns to processing block 301 to repeat the operation of the loop.

In the event a defrosting operation is required, program 300 controls a defrosting operation (subroutine 330). Subroutine 330 illustrates the technique of the prior art of reversing the operation of heat pump 100 described above. This is shown as an example only and other techniques may be employed. In particular it is feasible to employ an auxiliary heater to heat exterior heat exchanger 150 under these conditions.

Subroutine 330 first reverses refrigerant flow switch 120 (processing block 331). This is accomplished by provision of the proper command from microprocessor 200 to output controller 250. Subroutine 330 then turns compressor motor 105 on (processing block 332). This causes the heated liquid refrigerant from compressor 110 to be supplied to exterior heat exchanger 150 for defrosting incidentally removing heat from the interior space via interior heat exchanger 130 in the process.

Subroutine 330 then measures the exterior heat exchanger temperature $T_e$ in the same manner as previously described (processing block 333). Subroutine 330 then tests to determine if exterior heat exchanger temperature $T_e$ is less than or equal to freezing (decision block 334). If this is true then control returns to processing block 333 to repeat the temperature measurement. Note, as in the case of operating exterior fan 157, subroutine 330 is structured so that the normal heating operation of heat pump 100 cannot begin until exterior heat exchanger 150 is defrosted. The subroutine 330 remains in this loop until exterior heat exchanger temperature $T_e$ is greater than freezing. Once this occurs then the defrosting operation is complete. Subroutine 330 then turns off compressor motor 105 (processing block 335) and resets refrigerant flow switch 120 to normal flow (processing block 336). Upon completion of these tasks, program 300 returns to processing block 301 to repeat the control loop.

Figure 4:
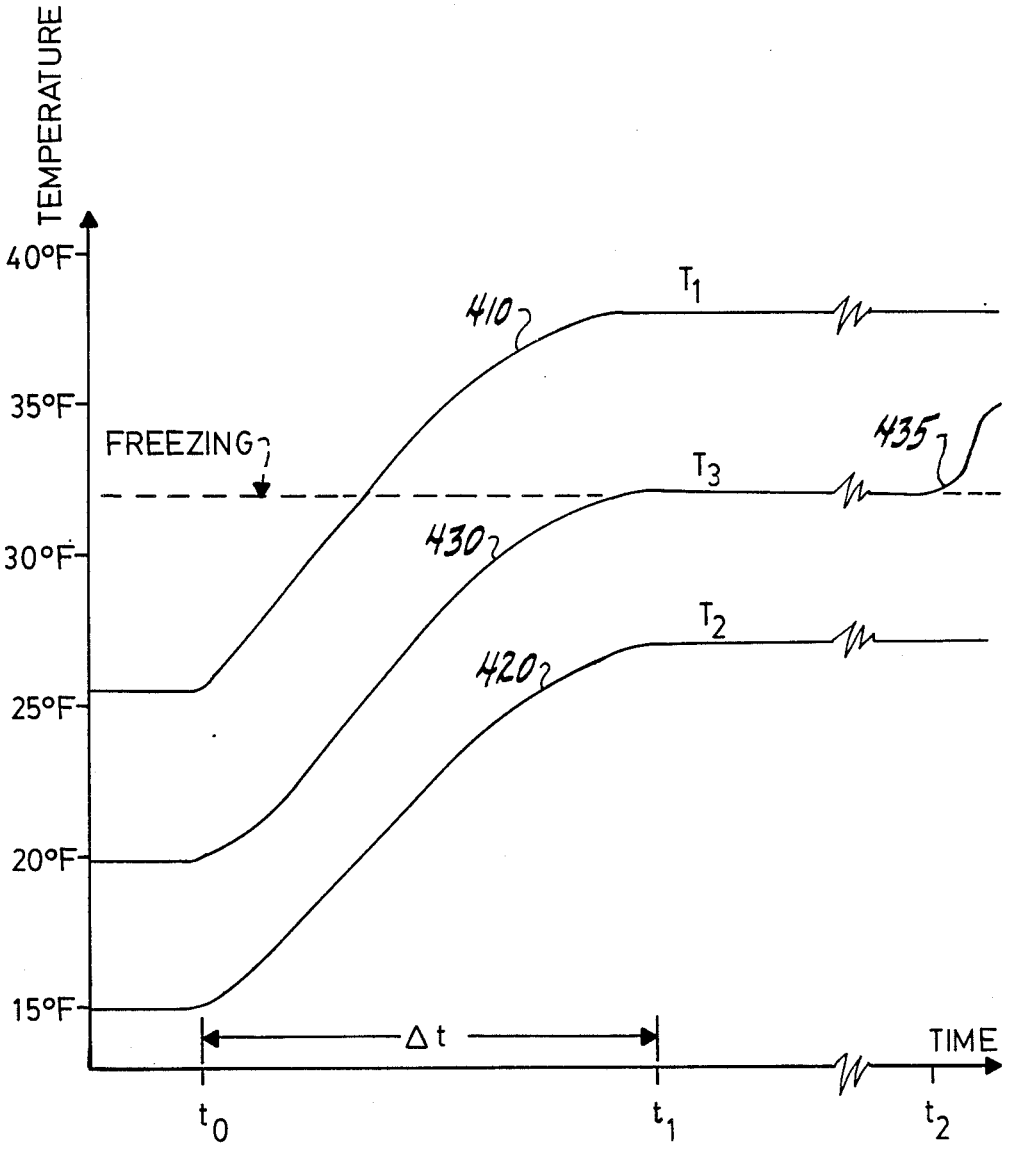
FIG. 4 illustrates the temperature versus time profile of the exterior heat exchanger for the three conditions detected by the present invention.

FIG. 4 illustrates the time/temperature profile of the exterior heat exchanger for times after the compressor is turned off. The vertical scale is in degrees Fahrenheit. Note that freezing (32 degrees Fahrenheit) is marked on the graph. FIG. 4 illustrates three cases in curves 410, 420 and 430, respectively.

In FIG. 4, time $t_O$ corresponds to the time in which the compressor is turned off. Prior to time $t_O$ the temperature measured by the sensor placed on exterior heat exchanger 150 corresponds to the lowest temperature achievable by heat pump 100 under operating conditions and is a function of the construction of the particular heat pump. At times following time $t_O$ the temperature of exterior heat exchanger 150 rises toward a quiescent level which is dependent upon the internal temperature and the exterior ambient temperature.

Curve 410 shows a rise to a quiescent temperature $T_1$ which is above freezing. This condition occurs when the exterior ambient temperature is above freezing. In such an event no frost is formed on exterior heat exchanger 150.

Curve 420 shows a rise to a quiescent temperature $T_2$ which is below freezing. In this case the exterior ambient temperature is below freezing. In such an event it is unknown whether or not frost is formed on exterior heat exchanger 150. However, the formation of frost is likely and further it is clear that exterior heat exchanger 150 cannot be defrosted by running exterior fan 157 to move exterior air across exterior heat exchanger 150. This is because the exterior ambient temperature is below freezing.

Curve 430 shows a rise to a quiescent temperature $T_3$ equal to freezing, and a later rise in temperature at time $t_2$. This corresponds to the case in which there is an accumulation of frost on exterior heat exchanger 150 and the exterior ambient temperature is above freezing. The temperature of exterior heat exchanger 150 rises to freezing. Any heat transported to exterior heat exchanger 150 thereafter does not raise its temperature but rather melts some of the frost. After all the frost is melted at time $t_2$ the temperature of exterior heat exchanger 150 again begins to rise. It should be understood that the temperature of heat exchanger 150 would thereafter rise to its quiescent level, but this is not shown in FIG. 4.

Control of the deactuation of exterior fan 157 takes place based upon the exterior heat exchanger temperature profile. In a first embodiment the exterior heat exchanger temperature is measured at time $t_1$. This time $t_1$ is a predetermined time $\Delta t$ after the deactuation of compressor 110 at time $t_0$. This time is selected with a view to the length of time required for the temperature of exterior heat exchanger 150 to reach its quiescent level and is approximately four minutes. If the exterior heat exchanger temperature is above freezing or below freezing then exterior fan 157 is deactuated. Otherwise exterior fan 157 continues to operate until the exterior heat exchanger temperature rises above freezing.

Figure 5:
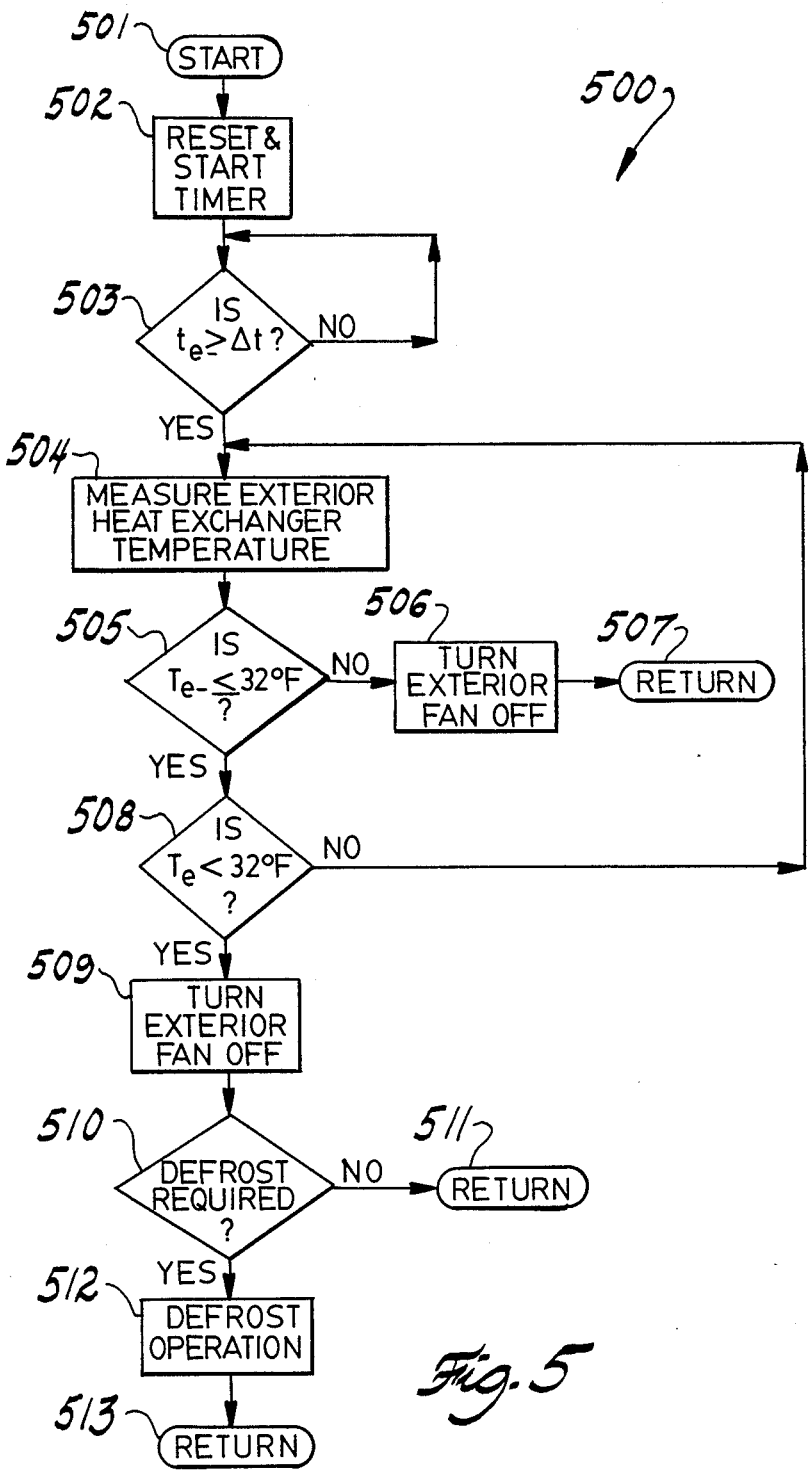
FIG. 5 illustrates a flow chart of a subroutine suitable for execution by the microprocessor illustrated in FIG. 2 for practicing an alternative embodiment of the present invention; and FIG. **6*a* and 6*b* illustrate a flow chart of a subroutine suitable for execution by the microprocessor illustrated in FIG. 2** for practicing a further embodiment of the present invention.

FIG. 5 illustrates a flow chart of subroutine 500 used to control the operation of microprocessor 200 for achieving the frost control in accordance with the present invention. Subroutine 500 is entered at the time that the thermostatic process turns off the compressor. In program 300 illustrated in FIG. 3, this would be after processing block 313. As in the case of program 300 illustrated in FIG. 3 and described above, subroutine 500 illustrated in FIG. 5 is not intended to show the exact details of the program for control of microprocessor 200 but only the overall general steps.

Subroutine 500 is concerned with the defrosting operation of heat pump 100. Subroutine 500 is entered via start block 501 only when the compressor motor 105 is turned off. This is at the end of a compressor cycle controlled by the thermostatic process of the main program. Subroutine 500 first resets and starts a timer (processing block 502). Subroutine 500 then tests to determined if the elapsed time $t_e$ of the timer is greater than or equal to the predetermined interval of time $\Delta t$ (decision block 503). As noted above, this predetermined period of time $\Delta t$ is approximately four minutes. If this is not the case then this test is repeated. If this is the case then subroutine 500 proceeds. These steps serve to continue operation of exterior fan 157 during the predetermined interval of time $\Delta t$.

Subroutine 500 next measures the exterior heat exchanger temperature $T_e$ (processing block 504). This takes place in much the same manner as the measurement of the interior temperature $T_i$ by reading and processing the signal from exterior temperature sensor(s) 220. In this embodiment of the present invention, only a single exterior temperature sensor 220 measuring the temperature of the exterior heat exchanger 150 is employed, because the control process does not employ the exterior ambient temperature $T_o$.

Subroutine 500 next tests to determine whether the exterior heat exchanger temperature $T_e$ is less than or equal to freezing (decision block 505). If this is not the case, then the condition illustrated in curve 410 of FIG. 4 exists and no defrosting operation is required. In such an event, exterior fan motor 155 is turned off (processing block 506) and subroutine 500 is exited (end block 507). This returns control to the beginning of the thermostatic control loop, such as processing block 301 of FIG. 3.

In the event that exterior heat exchanger temperature $T_e$ is less than or equal to freezing, the conditions exist promoting the formation of frost on exterior heat exchanger 150. If this is the case one of two defrost operations may be performed.

Subroutine 500 tests to determine if the exterior heat exchanger temperature $T_e$ is less than freezing (decision block 508). If this is not the case, that is if the exterior heat exchanger temperature $T_e$ equals freezing then the exterior fan remains on. Subroutine 500 then returns control to processing block 504 to repeat the temperature measurement. This condition corresponds to the plateau at freezing of curve 430 illustrated in FIG. 4. Under these conditions, the exterior ambient temperature is believed to be above freezing so that continued operation of exterior fan 157 will promote defrosting. Subroutine 500 remains in this loop, with exterior fan 157 operating until either exterior heat exchanger temperature $T_e$ is no longer less than or equal to freezing (decision block 505) or exterior heat exchanger temperature $T_e$ is less than freezing (decision block 508). In the former case the heat from the exterior air has defrosted exterior heat exchanger 150. The latter case is a pathological condition which ordinarily would not occur unless the exterior ambient temperature drops after the end of the predetermined interval of time $\Delta t$. Note particularly that subroutine 500 cannot restart heat pump 100 for heating the interior space until the frost forming conditions no longer occur.

In the event that exterior heat exchanger temperature $T_e$ is less than freezing, the the exterior air cannot supply the heat to defrost exterior heat exchanger 150. The exterior fan 157 is turned off (processing block 509). Next subroutine 500 tests to determine if a defrost operation is required (decision block 510). This is similar to the defrost test determination discussed above at decision block 321 illustrated in FIG. 3. If no defrost operation is required, then subroutine 500 is exited via end block 511. This returns control of heat pump 100 to the main program. If a defrosting operation is required, then it is done (processing block 512). This defrosting operation is the same as subroutine 330 illustrated in FIG. 3. Then subroutine 500 is ended via end block 513, returning control to the main program.

Figure 6A:
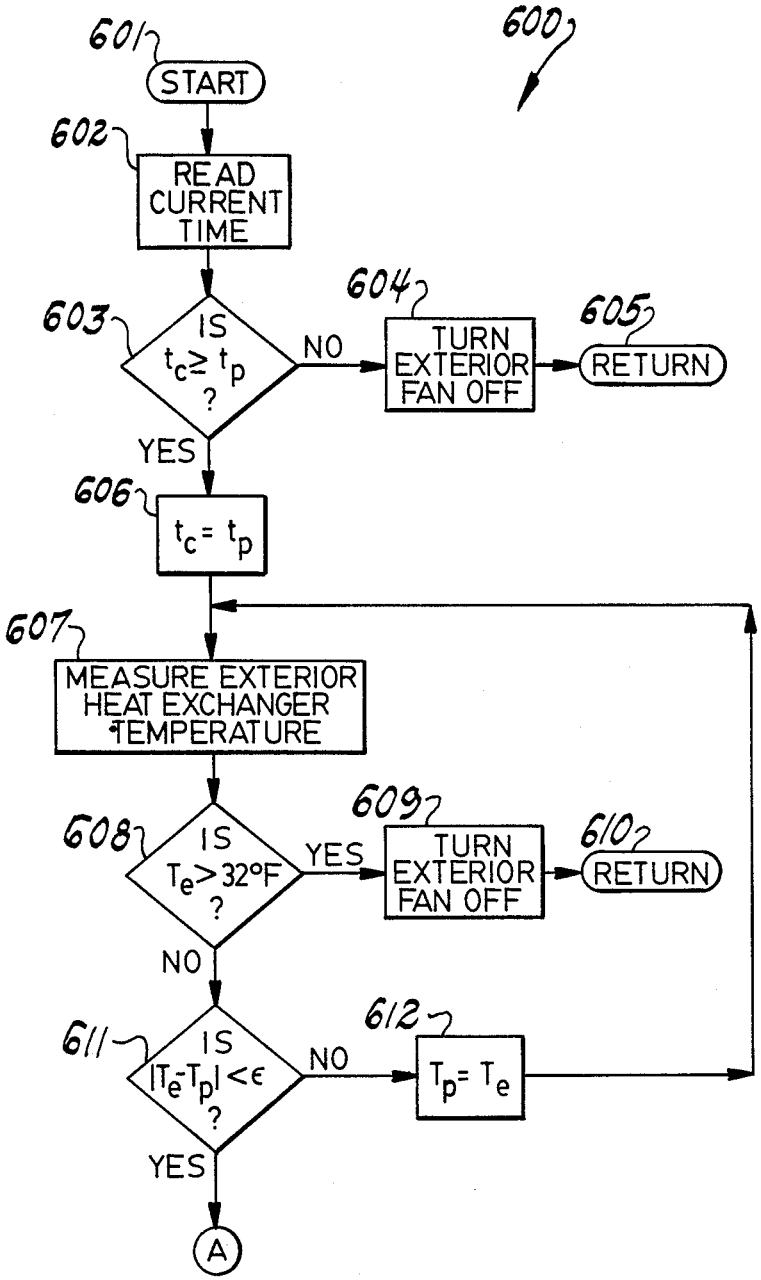
Figure 6B:
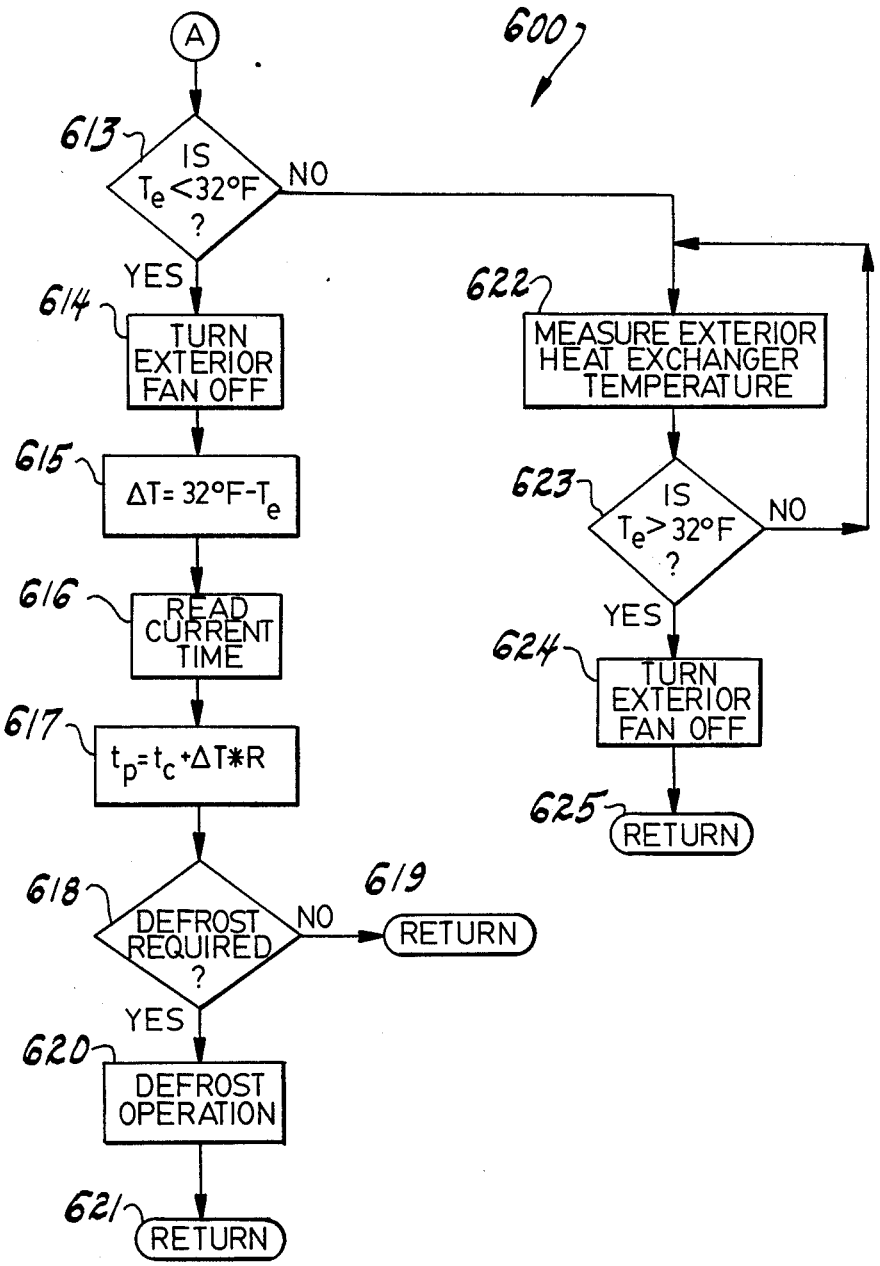

FIGS. 6*a* and 6*b* illustrate a flow chart of subroutine 600 used to control the operation of microprocessor 200 for achieving the frost control in accordance with the present invention. Subroutine 600 is an alternative to subroutine 500 illustrated in FIG. 5. Subroutine 600 is entered at the time that the thermostatic process turns off the compressor. In program 300 illustrated in FIG. 3, this would be after processing block 313. As in the case of program 300 illustrated in FIG. 3 and described above, subroutine 600 illustrated in FIGS. 6*a* and 6*b* is not intended to show the exact details of the program for control of microprocessor 200 but only the overall general steps.

Subroutine 600 is concerned with the defrosting operation of heat pump 100. Subroutine 600 is entered via start block 601 only when the compressor motor 105 is turned off. This is at the end of a compressor cycle controlled by the thermostatic process of the main program. Subroutine 600 includes two procedures which are not included within subroutine 500. These two procedures include: omitting any exterior fan overrun if prior conditions indicate that operating the exterior fan would not aid in defrosting; and operating the exterior fan until the exterior heat exchanger temperature rises above freezing or reaches a plateau temperature below freezing. These two procedures will be described in full in the following description of subroutine 600.

Subroutine 600 is begun via start block 601. Subroutine 600 initially tests to determine whether prior conditions indicate that operating the exterior fan would not aid in defrosting permitting omission of any exterior fan overrun. This is achieved by reading the current time from the real time clock included within microprocessor 200 (processing block 602). It has been previously noted that a number of functions known in the prior art require an indication of the current time. In particular it is considered advantageous to enable controller 160 to operate heat pump 100 to achieve a predetermined profile of desired temperatures at desired times. In the event that such a function is implemented, then microprocessor 200 includes a real time clock capable of indicating the current time. This real time clock is read to indicate the current time $t_c$.

Subroutine 600 next tests to determine if the current time $t_c$ is later than or equal to a previously set permitted time $t_p$ for overrun operation of the exterior fan 157 (decision block 603). The permitted time $t_p$ is set in a manner that will be disclosed below. If the current time $t_c$ is not later than or equal to this permitted time $t_p$, then the exterior fan 157 is turned off (processing block 604) and subroutine 600 is exited via return block 605. In the other case, the permitted time $t_p$ is set equal to the current time $t_c$ (processing block 606). This serves to ensure that the overrun operation of the exterior fan 157 will be permitted during the next execution of subroutine 600 unless the permitted time $t_p$ is elsewhere set to a differing value.

Subroutine 600 then measures the exterior heat exchanger temperature $T_e$ (processing block 607). This takes place in much the same manner as the measurement of the interior temperature $T_i$ by reading and processing the signal from exterior temperature sensor(s) 220. In this embodiment of the present invention, only a single exterior temperature sensor 220 measuring the temperature of the exterior heat exchanger 150 is employed, because the control process does not employ the exterior ambient temperature $T_o$.

Subroutine 600 next tests to determine whether the exterior heat exchanger temperature $T_e$ is greater than freezing (decision block 608). If this is the case, then the condition illustrated in curve 410 of FIG. 4 exists and no defrosting operation is required. In such an event, exterior fan motor 155 is turned off (processing block 609) and subroutine 600 is exited (end block 610). This returns control to the beginning of the thermostatic control loop, such as processing block 301 of FIG. 3.

In the event that exterior heat exchanger temperature $T_e$ is not greater than freezing, subroutine 600 tests to determine if the absolute value of the difference between the last measured temperature of the exterior heat exchanger $T_e$ and the prior measured temperature of the exterior heat exchanger $T_p$ is less than a small value $\epsilon$ (decision block 611). This test determines if the temperature of the exterior heat exchanger has reached a plateau or not. If this test fails, indicating that the temperature is changing, then the prior measured temperature of the exterior heat exchanger $T_p$ is set equal to the last measured temperature of the exterior heat exchanger $T_e$ (processing block 612) and control is returned to processing block 607 to repeat the temperature measurement. Subroutine 600 remains in this loop, with the exterior fan 157 operating, until either the measured temperature of the exterior heat exchanger $T_e$ is greater than freezing (decision block 608) or a temperature plateau is reached (decision block 611).

Subroutine 600 next tests to determine if the exterior heat exchanger temperature $T_e$ is less than freezing (decision block 613). If this is the case, the the exterior air cannot supply the heat to defrost exterior heat exchanger 150 because this corresponds to curve 420 illustrated in FIG. 4. The exterior fan 157 is therefore turned off (processing block 614).

It is under these conditions that the permitted time $t_p$ is set. The difference $\Delta t$ between freezing and the measured exterior heat exchanger temperature $T_e$ is formed (processing block 615). The current time $t_c$ is read from the real time clock (processing block 616). This process takes place as previously described with regard to processing block 602. The permitted time $t_p$ is formed of the sum of the current time $t_c$ and the product of $\Delta t$ and a predetermined temperature change rate R (processing block 617). The temperature change rate R is set to somewhat less than the maximum rate of change expected in the exterior ambient temperature. Ordinarily the exterior ambient temperature is not expected to change at a rate of more than 1 degree Fahrenheit per hour. In the preferred embodiment the temperature change rate R is set to 2 degrees Fahrenheit per hour.

This process of setting the permitted time $t_p$ employs the following theory. In the case that the time/temperature profile is as illustrated at curve 420 of FIG. 4, the exterior ambient temperature is below freezing. The independent operation of exterior fan 157 can be of no value in defrosting exterior heat exchanger 150 in such a case. In addition, it should be realized that the exterior ambient temperature must rise for there to be any utility in the independent operation of exterior fan 157. The difference $\Delta t$ between the plateau temperature and freezing is employed to determine the earliest time that exterior fan operation after deactuation of the compressor may be advantageous. This permitted time $t_p$ is calculated with the aid of the temperature change rate R. Thus the temperature difference $\Delta t$ is translated into a time. As noted above, no exterior fan overrun is employed until after this permitted time $t_p$. This process serves to conserve the energy employed in operating exterior fan 157 under circumstances where this energy would be wasted.

Note that the above described determination of a permitted time for operation of the exterior fan 157 could equally well be employed in the defrost operation of in subroutine 500 illustrated in FIG. 5. In this event program steps 602 to 606 would be placed between the start 501 of subroutine 500 and processing block 502 and program steps 614 to 617 would be placed between program steps 509 and 510 of subroutine 500.

Next subroutine 600 tests to determine if a defrost operation is required (decision block 618). This is similar to the defrost test determination discussed above at decision block 327 illustrated in FIG. 3. If no defrost operation is required, then subroutine 600 is exited via end block 619. This returns control of heat pump 100 to the main program. If a defrosting operation is required, then it is done (processing block 620). This defrosting operation is the same as subroutine 330 illustrated in FIG. 3. Then subroutine 600 is ended via end block 621, returning control to the main program.

If the exterior heat exchanger temperature $T_e$ equals freezing then the exterior fan remains on. This condition corresponds to the plateau at freezing of curve 430 illustrated in FIG. 4. Under these conditions, the exterior ambient temperature is believed to be above freezing so that continued operation of exterior fan 157 will promote defrosting. Subroutine 600 then measures the temperature of the exterior heat exchanger $T_e$ (processing block 622). Subroutine 600 tests to determine whether the measured exterior heat exchanger temperature $T_e$ is greater than freezing (decision block 623). If this is not the case, then control is returned to processing block 622 to repeat the exterior heat exchanger temperature measurement (processing block 622).

Subroutine 600 remains in this loop, with exterior fan 157 operating until the exterior heat exchanger temperature $T_e$ is greater than freezing (decision block 623). When this test is satisfied, the exterior fan 157 is turned off (processing block 624). Subroutine 600 is then ended via end block 625, returning control to the main program.

I claim:

1. A method of defrosting operation of a heat pump having a compressor, an interior heat exchanger, an exterior heat exchanger, an exterior fan for moving exterior air past the exterior heat exchanger, and a thermostatic control means for cycling the compressor ON and OFF in accordance with heating demand, the improvement comprising the steps of:

operating the exterior fan for a predetermined interval of time immediately after the compressor is cycled OFF by the thermostatic control means;

measuring the temperature of the exterior heat exchanger at the end of said predetermined interval of time; and continuing to operate the exterior fan only if said measured temperature of the exterior heat exchanger is equal to freezing.

2. The method of defrosting operation of a heat pump as claimed in claim 1, further comprising the steps of:

repeatedly measuring the temperature of the exterior heat exchanger if said measured temperature of the exterior heat exchanger at the end of said predetermined interval of time was freezing; and deactuating the exterior fan if one of said repeated measurements of the temperature of the exterior heat exchanger indicate a temperature greater than freezing.

3. The method of defrosting operation of a heat pump as claimed in claim 1, further comprising the steps of:

repeatedly measuring the temperature of the exterior heat exchanger if said measured temperature of the exterior heat exchanger at the end of said predetermined interval of time was freezing; and deactuating the exterior fan if one of said repeated measurements of the temperature of the exterior heat exchanger indicate a temperature less than freezing.

4. The method of defrosting operation of a heat pump as claimed in claim 1, wherein:

said predetermined interval of time of operating the exterior fan immediately after the compressor is cycled OFF by the thermostatic control means consists of a predetermined fixed interval of time.

5. The method of defrosting operation of a heat pump as claimed in claim 4, wherein:

said predetermined fixed interval of time of operation of the exterior fan after the compressor is cycled OFF is approximately four minutes.

6. The method of defrosting operation of a heat pump as claimed in claim 1, wherein:

said step of operating the exterior fan after the compressor is cycled OFF by the thermostatic control means is inhibited throughout an inhibition interval of time if said digital exterior heat exchanger temperature signal at the end of said predetermined interval of time is less than freezing.

7. The method of defrosting operation of a heat pump as claimed in claim 6, wherein:

said inhibition interval of time during which the step of operating the exterior fan after the compressor is cycled OFF by the thermostatic control means is inhibited is computed from the difference between freezing and said digital exterior heat exchanger temperature signal at the end of said predetermined interval of time.

8. The method of defrosting operation of a heat pump as claimed in claim 7, wherein:

said inhibition interval of time during which the step of operating the exterior fan after the compressor is cycled OFF by the thermostatic control means is inhibited is computed in accordance with the following equation:

$$\Delta t=(T_{freeze}-T_e)\times R$$

where $\Delta t$ is the inhibition interval of time during which operation of the exterior fan after the compressor is cycled OFF is inhibited, $T_{freeze}$ is the temperature of freezing (32 degrees Fahrenheit), $T_e$ is said digital exterior heat exchanger temperature signal at the end of said predetermined interval of time and R is a temperature change rate constant.

9. The method of defrosting operation of a heat pump as claimed in claim 8, wherein:

said temperature change rate constant R is 2 degrees Fahrenheit per hour.

10. An electronic thermostat for control of a heat pump for heating an interior space, the heat pump including a compressor, an interior heat exchanger, an evaporator, an exterior heat exchanger and an exterior fan for moving exterior air past the exterior heat exchanger, said electronic thermostat comprising:

an interior temperature sensor for generating a digital interior temperature signal indicative of the ambient air temperature within the interior space;

a desired temperature means for generating a digital desired temperature signal indicative of a predetermined desired temperature;

a first control means connected to the compressor, the exterior fan, said interior temperature sensor and said desired temperature means for cycling ON and OFF the compressor to warm the interior space based upon the relationship between said interior temperature signal and said desired temperature signal;

an exterior ambient temperature means for generating a digital exterior heat exchanger temperature signal indicative of the temperature of the exterior heat exchanger; and a second control means connected to said first control means and said exterior ambient temperature means for operating the exterior fan for a predetermined interval of time immediately after the compressor is cycled OFF by said first control means, following expiration of said predetermined interval of time repeatedly comparing said exterior heat exchanger temperature signal to freezing, and continuing to operate the exterior fan following expiration of said predetermined interval of time only if said exterior heat exchanger temperature signal is equal to freezing.

11. The method of defrosting operation of a heat pump as claimed in claim 10, wherein:

said predetermined interval of time of operating the exterior fan immediately after the compressor is cycled OFF by the thermostatic control means consists of a predetermined fixed interval of time.

12. The electronic thermostat for control of a heat pump as claimed in claim 11, wherein:

said predetermined fixed interval of time of operation of the exterior fan after the compressor is deactuated is approximately four minutes.

13. The method of defrosting operation of a heat pump as claimed in claim 10, further comprising:

a third control means connected to said exterior ambient temperature means and said second control means for inhibiting throughout an inhibition interval of time operation of the exterior fan immediately after the compressor is cycled OFF by said first control means if said digital exterior heat exchanger temperature signal at the end of said predetermined interval of time is less than freezing.

14. The method of defrosting operation of a heat pump as claimed in claim 13, wherein:

said third control means computes said inhibition interval of time from the difference between freezing and said digital exterior heat exchanger temperature signal at the end of said predetermined interval of time.

15. The method of defrosting operation of a heat pump as claimed in claim 14, wherein:

said third control means computes said inhibition interval of time in accordance with the following equation:

$$\Delta t=(T_{freeze}-T_e)\times R$$

where $\Delta t$ is the inhibition interval of time during which operation of the exterior fan after the compressor is cycled OFF is inhibited, $T_{freeze}$ is the temperature of freezing (32 degrees Fahrenheit), $T_e$ is said digital exterior heat exchanger temperature signal at the end of said predetermined interval of time and R is a temperature change rate constant.

16. The method of defrosting operation of a heat pump as claimed in claim 15, wherein:

said temperature change rate constant R is 2 degrees Fahrenheit per hour.

* * * * *